US008187075B2

(12) United States Patent
Koyama

(10) Patent No.: US 8,187,075 B2
(45) Date of Patent: May 29, 2012

(54) GAMING MACHINE

(75) Inventor: Toshimi Koyama, Koto-ku (JP)

(73) Assignee: Universal Entertainment Corporation, Koto-Ku, Tokyo (JP)

( * ) Notice: Subject to any disclaimer, the term of this patent is extended or adjusted under 35 U.S.C. 154(b) by 876 days.

(21) Appl. No.: 12/263,717

(22) Filed: Nov. 3, 2008

(65) Prior Publication Data

US 2009/0117967 A1 May 7, 2009

(30) Foreign Application Priority Data

Nov. 6, 2007 (JP) ..... 2007-288192

(51) Int. Cl.
*A63F 9/24* (2006.01)

(52) U.S. Cl. ..... 463/17; 463/9; 340/572.7

(58) Field of Classification Search ..... 463/9, 17; 340/572.7

See application file for complete search history.

(56) References Cited

U.S. PATENT DOCUMENTS

| | | | | |
|---|---|---|---|---|
| 6,392,544 | B1 * | 5/2002 | Collins et al. | 340/572.7 |
| 6,903,656 | B1 * | 6/2005 | Lee | 340/572.1 |
| 7,561,053 | B2 * | 7/2009 | Hecht et al. | 340/572.7 |
| 7,612,675 | B2 * | 11/2009 | Miller et al. | 340/572.3 |
| 7,852,223 | B2 * | 12/2010 | Hecht et al. | 340/572.7 |
| 7,928,847 | B2 * | 4/2011 | Murdoch et al. | 340/572.7 |
| 2004/0135734 | A1 * | 7/2004 | Uesaka et al. | 343/867 |
| 2005/0054406 | A1 * | 3/2005 | Hazama | 463/9 |
| 2007/0057469 | A1 * | 3/2007 | Grauzer et al. | 273/309 |
| 2007/0060311 | A1 * | 3/2007 | Rowe et al. | 463/25 |
| 2008/0074271 | A1 * | 3/2008 | Hodges | 340/572.7 |
| 2009/0221364 | A1 * | 9/2009 | Richard et al. | 463/29 |
| 2010/0093428 | A1 * | 4/2010 | Mattice et al. | 463/25 |

FOREIGN PATENT DOCUMENTS

| | | |
|---|---|---|
| JP | 2004-102953 | 4/2004 |
| JP | 2004-105321 | 4/2004 |
| WO | WO 2007038858 A1 * | 4/2007 |

* cited by examiner

*Primary Examiner* — Xuan Thai
*Assistant Examiner* — Michael Grant
(74) *Attorney, Agent, or Firm* — Lexyoume IP Group, PLLC.

(57) ABSTRACT

A gaming machine includes a gaming table, antennas and a control unit. The antennas are arranged to placement areas formed on the gaming table. The antennas are employed to determine whether or not at least one gaming medium is placed on any of the placement areas. The control unit drives at least two antennas simultaneously so that a direction of magnetic field generated by one antenna is opposed to one generated by at least one other antenna adjacent to the one antenna.

3 Claims, 7 Drawing Sheets

GAMING MACHINE

CROSS REFERENCE TO RELATED APPLICATION

This application claims benefit of priority under 35 U.S.C. §119 to Japanese Patent Application No. 2007-288192, filed on Nov. 6, 2007, the entire contents of which are incorporated by reference herein.

BACKGROUND OF THE INVENTION

1. Field of the Invention

The present invention relates to a gaming machine configured to allow one or more players to place one or more gaming media such as gaming chips or gaming cards to which one or more pieces of identification information are assigned respectively, on any of placement areas such as betting areas of a gaming table, and then play a game.

2. Description of the Related Art

Before playing a game such as roulette or card-playing in a game hall such as a casino, a player exchanges money for one or more gaming media such as gaming chips or gaming cards. The player plays the game using one or more gaming media and then cashes one or more gaming media obtained in the game.

For example, in roulette, gaming chips given to each player have colors that differ from ones of other gaming chips given to other players so that a croupier can identify each player at betting time. A numeral or mark related to a value (e.g., 1 cent, 5 cents, 10 cents or 100 cents) of gaming chip is assigned (incused) to the gaming chip so that the croupier can easily identify kinds of gaming chips. The croupier provides one or more gaming chips to each winning player according to values of gaming chips bet on a current game and multiplying power in the current game every time one game is finished. Each player can cash one or more gaming chips obtained in the roulette anytime.

Recently, a gaming medium in which an IC tag is embedded is used in a game. The IC tag stores a unique identification code of the gaming medium and a code representing a value of the gaming medium therein. A system smoothly carries out a game while identifying a unique identification code and the like stored in an IC tag of each gaming medium during the game.

Generally, on a gaming table, a placement area (e.g., betting area) on which one or more gaming media are to be placed is adjacent to other placement areas. If the gaming table is small and/or the number of placement areas is large, each placement area becomes smaller. In this condition, if a lot of players play a game simultaneously, a gaming medium that is placed on a desired placement area and bet by each player is likely to cover on another placement area adjacent to the desired placement area.

In order to surely detect a gaming medium placed on a desired placement area and bet by each player without interfering in a progression of game, a solution using an IC tag embedded in a gaming medium has been conventionally proposed.

For example, patent documents 1 (Japanese Published Unexamined Application No. 2004-105321) and 2 (Japanese Published Unexamined Application No. 2004-102953) disclose a gaming machine configured to arrange X-array antennas for emitting radio waves along an X-direction (e.g., longitudinal direction) of gaming table and Y-array antennas for emitting radio waves along a Y-direction (e.g., lateral direction) of gaming table under the gaming table, so as to read information stored in an IC tag embedded in a gaming medium. When an X-array antenna and a Y-array antenna emit radio waves, a magnetic field is generated in an upward direction vertical to the gaming table at each cross point where a radio wave from the X-array antenna crosses one from the Y-array antenna. The gaming machine reads information stored in an IC tag embedded in a gaming medium placed on a cross point using the magnetic field to detect a placement condition of gaming medium. It is noted that each cross point corresponds to each placement area on which a gaming medium is to be placed.

In the gaming machine, when the detection of placement conditions is carried out, it sequentially scans all cross points while generating a magnetic field in the upward direction at each cross point. At this time, magnetic field lines concentrically diffuse at each cross point according to the corkscrew rule. If the magnitude of magnetic field generated is large, the gaming machine is likely to detect a gaming medium placed on another cross point adjacent to a cross point concerned where the magnetic field is generated in the upward direction because the magnetic field lines return in a downward direction by the diffusion to pass through the another cross point. In this case, the gaming machine incorrectly determines that the gaming medium placed on the another cross point is placed on the cross point concerned.

In order to avoid the above-described incorrect detection, it is necessary to reduce the magnitude of magnetic field by an output control of magnetic field. In the output control, if the magnitude of magnetic field generated is too small, the gaming machine can not detect placement conditions of gaming media which are accumulated on a cross point where the magnetic field is generated. Namely, the gaming machine can not surely read plural pieces of information stored in IC tags embedded in the gaming media which are accumulated on the cross point.

SUMMARY OF THE INVENTION

It is an object of the present invention to provide a gaming machine capable of surely detecting whether or not a gaming medium is placed on a placement area.

In order to achieve the object, the present invention provides a gaming machine comprising: a gaming table on which placement areas are formed, at least one gaming medium to which identification information is assigned is placed on any of the placement areas; detecting units that are arranged to the placement areas and employed to determine whether or not at least one gaming medium is placed on any of the placement areas; and a control unit that drives each of the detecting units to generate a radio wave from a detecting unit in a direction for passing through a placement area to which the detecting unit is arranged, so as to read identification information assigned to at least one gaming medium placed on the placement area and carry out the determination, wherein the control unit simultaneously drives at least two detecting units so that a polar character of radio wave generated by one detecting unit is opposed to one generated by at least one other detecting unit adjacent to the one detecting unit.

According to the present invention, a polar character of radio wave (e.g., a direction of magnetic filed) generated by one detecting unit is opposed to one generated by at least one other detecting unit adjacent to the one detecting unit. This allows the radio wave (e.g., magnetic filed line) to have a loop shape, which closes the radio wave in a narrow region without diffusing unnecessarily. Therefore, the gaming machine can surely determine whether or not at least one gaming medium is placed on any of the placement areas.

DESCRIPTION OF THE PREFERRED EMBODIMENTS

Figure 1A:
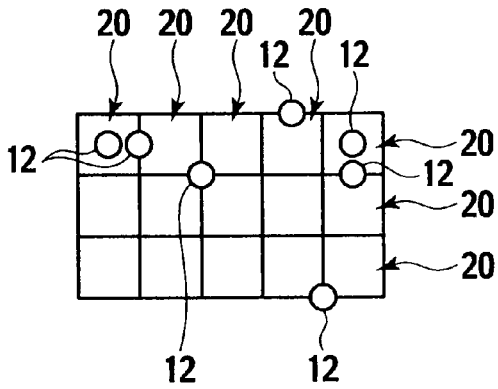
FIG. 1A is a plane view of betting areas of a gaming machine according to an exemplary embodiment of the present invention.

With reference to FIGS. 1A to 8, an exemplary embodiment of the present invention will be described below.

If a gaming machine according to the exemplary embodiment of the present invention meets a condition where one or more gaming media to which one or more pieces of identification information are assigned respectively can be placed on any of placement areas (e.g., betting area) of a gaming table to play a game, a type, size and shape of the gaming machine are especially not limited. For example, the gaming machine is a table gaming machine such as a roulette gaming machine configured to allow players to participate in a roulette simultaneously and to place gaming media on desired betting areas to play the roulette, or a card gaming machine configured to allow players to participate in a card game (e.g., poker or blackjack) simultaneously and to place gaming media on desired betting areas to play the card game.

As identification information assigned to a gaming medium, for example, there are/is a code representing a value of the gaming medium and/or an identification code uniquely assigned to a game hall. The gaming machine recognizes identification information assigned to a gaming medium, which smoothly carries out a game and efficiently prevents a malicious player from misbehaving (e.g., in a casino concerned, using a gaming medium that has been used in another casino where an exchange rate differs from one of the casino concerned).

The gaming machine is provided with detecting units and a control unit. Each detecting unit is arranged on each placement area and is employed to detect whether or not a gaming medium is placed on the each placement area. The control unit drives a detecting unit to generate a magnetic field in a direction for passing through a placement area on which the detecting unit is arranged. Then, the control unit reads identification information from a gaming medium placed on the placement area using the magnetic field to detect the gaming medium.

In the exemplary embodiment, a wireless IC chip (IC tag) storing identification information (gaming value and game hall code) as RFID (Radio Frequency Identification) is embedded in a gaming medium. As the detecting units, antennas which are RF units are arranged on lower sides of placement areas (a back surface of a gaming table). As the control unit, a control device (e.g., antenna control device with RFID reader function) including a CPU (Central Processing Unit), a ROM (Read Only Memory), a RAM (Random Access Memory), a communication interface unit (communication IF unit) and a storage unit (magnetic disc device) is employed.

Under this configuration, the CPU reads in a working region on the RAM various programs such as an antenna driving control process and an identification information reading process stored in the ROM which is an inner memory, which allows the control unit to detect whether or not a gaming medium is placed on each placement area. The various programs may be supplied from an external server via a communication network.

It is noted that the identification information of gaming medium need not to be the same identification information (numeral, gaming value or game hall code) incused to the gaming medium. The identification information of gaming medium concerned may be obtained as needed, with reference to a list table in which plural pieces of identification information (e.g., unique identification codes) are related with gaming media respectively, and then be stored in the IC tag of the gaming medium concerned. In this case, the list table is stored in the storage unit or the external server.

Figure 4:
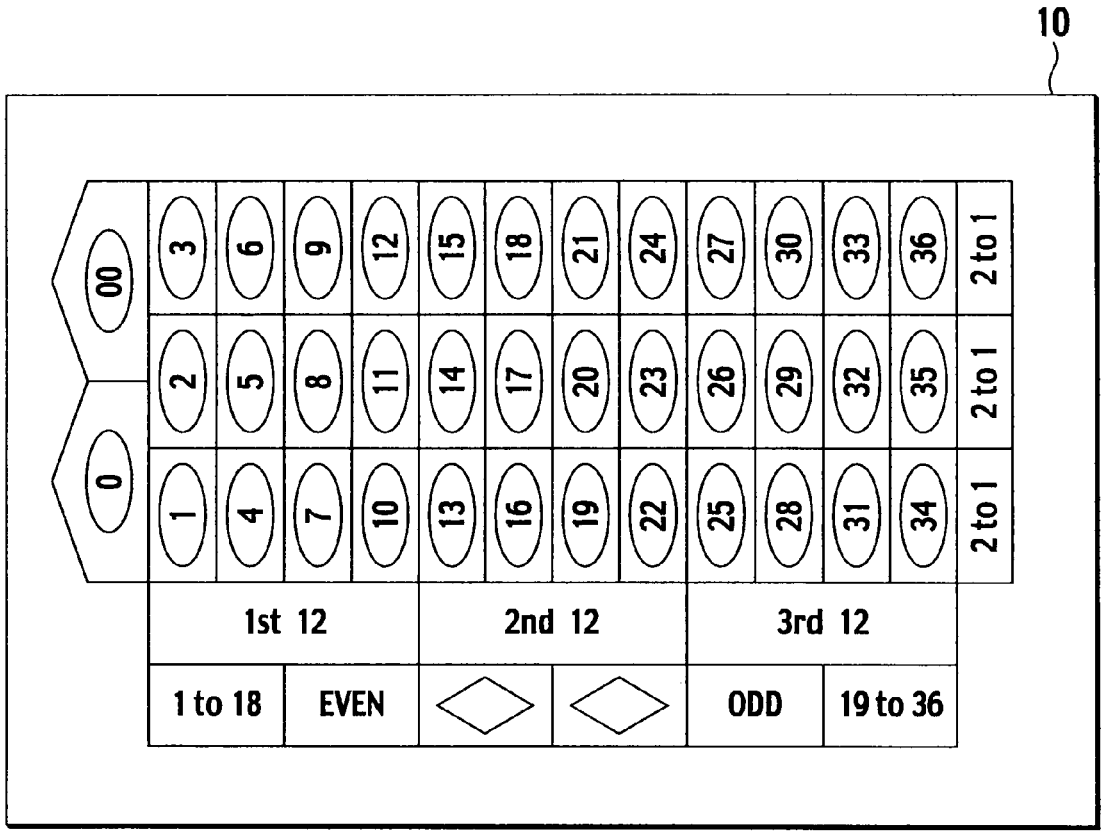
FIG. 4 is a plane view of a gaming table of the gaming machine according to the exemplary embodiment of the present invention.

Hereinafter, we assume a roulette gaming machine as the gamine machine according to the exemplary embodiment of the present invention. As shown in FIG. 4, the roulette gaming machine includes a gaming table 10 provided with various betting areas (e.g., numeral areas "0" to "36", odd number area, even number area, and serial areas "1st 12", "2nd 12", "3rd 12", "1 to 18", "19 to 36") on which one or more gaming chips will be placed. The roulette gaming machine plays a game after one or more players have placed one or more gaming chips on one or more desired betting areas.

Figure 1B:
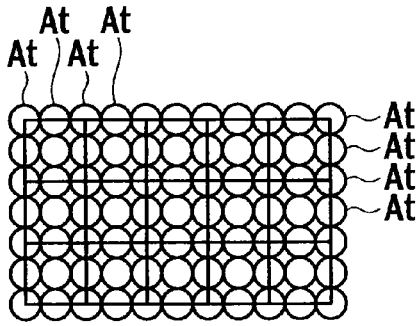
FIG. 1B is a plane view of an arrangement state of antennas of the gaming machine according to the exemplary embodiment of the present invention.

As shown in FIGS. 1A and 1B, the roulette gaming machine includes antennas At arranged under betting areas 20 (on a back side of the gaming table 10) so as to be opposed to the betting areas 20. As shown in FIGS. 1G, 1H and 5 to 7, each antenna At is connected to a control unit 14 via a switching unit 15 so as to be switched on/off individually. The control unit 14 controls each antenna At to generate a magnetic field on each antenna At a certain output level in a direction for crossing the betting area 20 concerned. It is noted that the output level is adjusted so that the control unit 14 can read plural pieces of information stored in all gaming chips 12 accumulated on a betting area 20 using the magnetic field generated.

Next, with reference to FIGS. 1A to 1H, a control method of each antenna At by the control unit 14 will be described in detail below.

As shown in FIGS. 1A to 1F, the antennas At are opposed to the betting areas 20 arranged on the gaming table 10 along columns (lines A, B, C, D . . . ) and rows (lines 1, 2, 3, 4 . . . ) via the gaming table 10. As shown in FIGS. 1G and 1H, the control unit 14 controls the switching unit 15 to drive each antenna At. The switching unit 15 connects the control unit 14 with each antenna At using a communication cable and supplies drive current or inductive current to each antenna At a suitable timing.

The control unit 14 sequentially selects and drives an antenna (specified antenna) At opposed to a betting area (specified betting area) on which it detects whether or not one or more gaming chips 12 are placed. In this time, the control unit 14 also selects and drives one or more antennas (adjacent antenna(s)) At adjacent to the specified antenna At. In this embodiment, A set of the antennas (specified antenna and adjacent antenna(s)) At selected at the same time is called an antenna set. Namely, the control unit 14 sets an antenna set (selects a specified antenna and adjacent antenna(s)) from among all antennas At and switches the antenna set on and antennas other than the antenna set off using the switching unit 15.

A state where an antenna At is switched on indicates a state where drive current or inductive current flows into the antenna At. On the other hand, a state where an antenna At is switched off indicates a state where the antenna At is not connected to the control unit 14 and drive current or inductive current does not flow into the antenna At.

Figure 5:
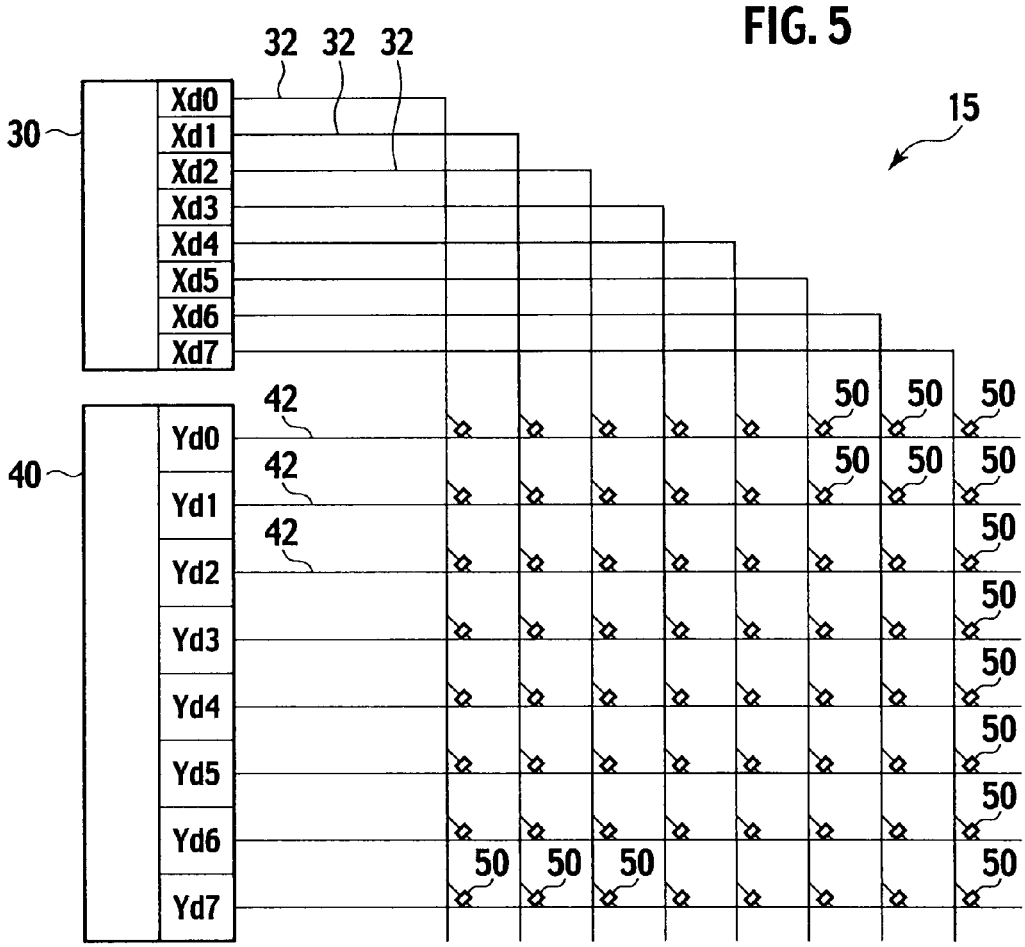
FIG. 5 is a circuit diagram illustrating a configuration of a switching unit of the gaming machine according to the exemplary embodiment of the present invention.

As shown in FIG. 5, the switching unit 15 is provided with an X side scan driver 30 and a Y side scan driver 40. Each antenna At is switchably connected to the control unit 14 via the X side scan driver 30 and the Y side scan driver 40. X side transmitting lines 32 extend from the X side scan driver 30 so as to be parallel to one another. Y side transmitting lines 42 extend from the Y side scan driver 40 so as to be parallel to one another. One of the X and Y side transmitting lines 32 and 42 extend along a longitudinal direction of the gaming table 10 and the other of the X and Y side transmitting lines 32 and 42 extend along a lateral direction of the gaming table 10. Under this configuration, the X side transmitting lines 32 cross the Y side transmitting lines 42, respectively. Relay circuits 50 are provided at cross points of the X and Y side transmitting lines 32 and 42.

Figure 6:
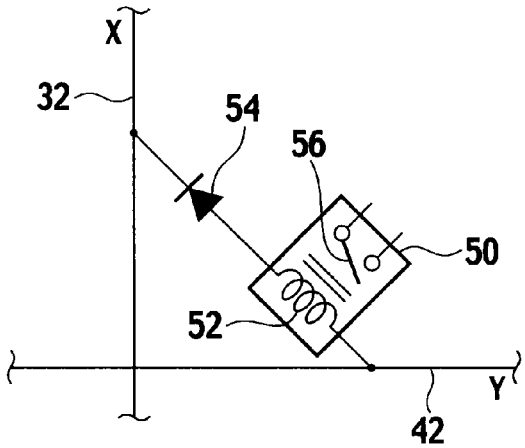
FIG. 6 is a circuit diagram illustrating a configuration of the switching unit of the gaming machine according to the exemplary embodiment of the present invention.

As shown in FIG. 6, each relay circuit 50 is connected to one of the X side transmitting lines 32 at one side of a coil 52 and one of the Y side transmitting lines 42 at the other side of the coil 52. A diode 54 is connected to the coil 52 and the one of the X side transmitting line 32 so that a cathode side and an anode side correspond to the X side transmitting line side and the coil side respectively.

When a relay circuit 50 is tuned off, X and Y side transmitting lines 32 and 42, which cross at a cross point where the relay circuit 50 is provided, are held at H and L levels respectively. On the other hand, when a relay circuit 50 is turned on, X and Y side transmitting lines 32 and 42, which cross at a cross point where the relay circuit 50 is provided, are held at L and H levels respectively. This allows current to flow a coil 52 to close a switch 56.

Figure 7:
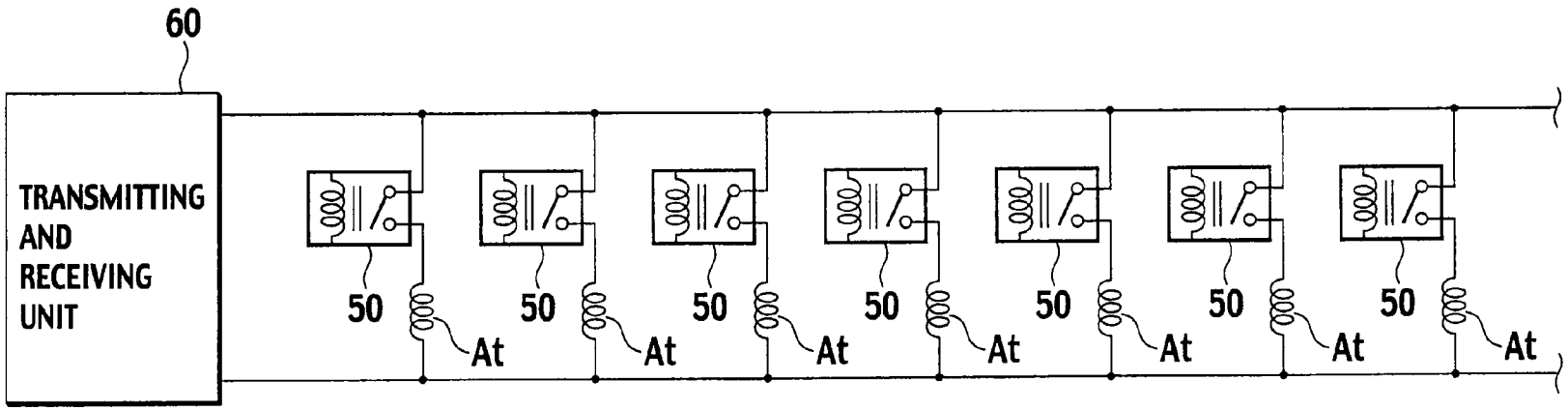
FIG. 7 is a circuit diagram illustrating a configuration of a control unit of the gaming machine according to the exemplary embodiment of the present invention.

As shown in FIG. 7, the relay circuits 50 are respectively related to the antennas At. More specifically, one antenna At is connected to one relay circuit 50 in series. If one relay circuit 50 is turned off, one antenna At concerned is not driven. If one relay circuit 50 is turned on, one antenna At concerned is driven. A transmitting and receiving unit 60 shown in FIG. 7 flows current into an antenna At connected to a relay circuit 50 turned on, and allows the control unit 14 to carry out a wireless communication with an IC tag 16 embedded in a gaming chip 12 placed on a betting area 20 using an antenna At and to read identification information stored in the IC tag 16.

In the antenna set, a coil of specified antenna At is wound in a direction opposed to one in which a coil of adjacent antenna At is wound. Under this condition, a direction of magnetic field generated on the specified antenna At is opposed to one generated on the adjacent antenna At. Therefore, when the antenna set is driven in the same phase using an oscillation circuit at the same time, a loop of magnetic field lines is generated on the specified antenna At and the adjacent antenna At.

For example, in the state of FIG. 1C, the antenna set is composed of a specified antenna At (hereinafter referred to as antenna B2) arranged at an intersection of a column B and a row 2 on the back side of the gaming table 10 and adjacent antennas At (hereinafter referred to as antennas A2 and C2) arranged at intersections of a column A and the row 2 and a column C and the row 2 on the back side of the gaming table 10. In this condition, the control unit 14 turns on the antennas A2, B2 and C2 and turns off antennas At other than the antennas A2, B2 and C2. If the control unit 14 drives the antennas A2, B2 and C2 at the same time, two loops of magnetic field lines are generated on the antennas A2 and B2 and the antennas B2 and C2 (see FIGS. 1G and 1H).

Since magnetic fields are generated only on the antenna set (antennas A2, B2 and C2) and the magnetic field lines have loop shapes on the antenna set, magnetic field lines are closed in a narrow region without diffusing unnecessarily.

In this condition, the control unit 14 reads pieces of identification information of gaming chips 12 placed on betting areas 20 corresponding to the antennas A2, B2 and C2. The read identification information is registered as row data of the antenna B2. The row data of the antenna B2 includes the pieces of identification information corresponding to the antennas A2, B2 and C2.

For another example, in the state of FIG. 1E, the antenna set is composed of a specified antenna At (hereinafter referred to as antenna B2) arranged at an intersection of a column B and a row 2 on the back side of the gaming table 10 and adjacent antennas At (hereinafter referred to as antennas B1 and B3) arranged at intersections of the column B and a row 1 and the column B and a row 3 on the back side of the gaming table 10. In this condition, the control unit 14 turns on the antennas B1, B2 and B3 and turns off antennas At other than the antennas B1, B2 and B3. If the control unit 14 drives the antennas B1, B2 and B3 at the same time, two loops of magnetic field lines are generated on the antennas B1 and B2 and the antennas B2 and B3 (see FIGS. 1G and 1H).

In this condition, the control unit 14 reads pieces of identification information of gaming chips 12 placed on betting areas 20 corresponding to the antennas B1, B2 and B3. The read identification information is registered as column data of the antenna B2. The column data of the antenna B2 includes the pieces of identification information corresponding to the antennas B1, B2 and B3.

Figure 8:
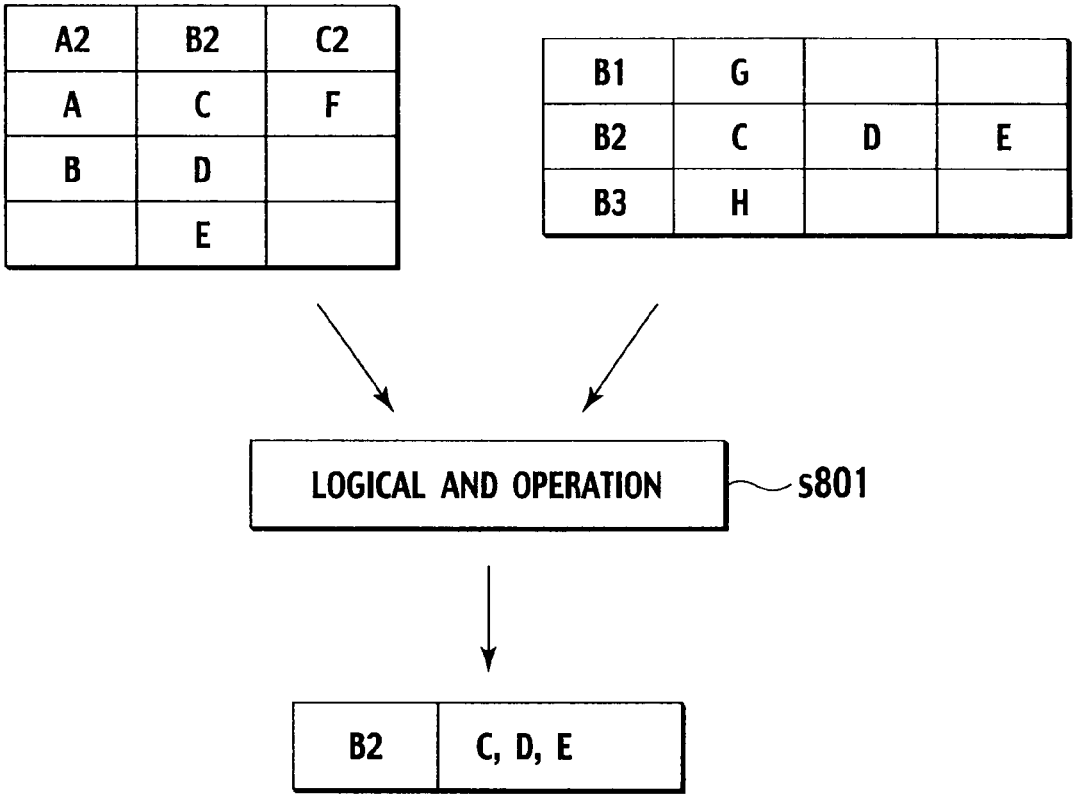
FIG. 8 is an explanatory diagram illustrating a method for identifying ID information of a gaming medium placed on a specified betting area according to the exemplary embodiment of the present invention.

Then, the control unit 14 compares the row and column data of the antenna B2, and carries out a logical AND operation with respect to the row and column data of the antenna B2. This allows the control unit 14 to recognize only identification information of a gaming chip 12 placed on a betting area (specified betting area) 20 located to the intersection of the column B and the row 2. For example, as shown in FIG. 8, in a case where the row data of the antenna B2 includes six pieces of identification information A, B, C, D, E and F and the column data of the antenna B2 includes five pieces of identification information C, D, E, G and H, the control unit 14 recognizes three pieces of identification information C, D and E as the identification information of the gaming chip 12 placed on the betting area (specified betting area) 20 located to the intersection of the column B and the row 2, by the logical AND operation (S801).

Thus, when antenna sets for a column line including a specified antenna and for a row line including the specified antenna generate magnetic fields, the control unit 14 can determine whether or not one or more gaming chips 12 are placed on a specified betting area corresponding to the specified antenna by the logical AND operation. If the control unit 14 determines that one or more gaming chips 12 are placed on the specified betting area, the control unit 14 can recognize one or more pieces of identification information of the one or more gaming chips 12 placed on the specified betting area at the same time. Then, the control unit 14 registers the determination and identification result of the specified betting area corresponding to the specified antenna.

The above-described processing is summarized as follows. In the first step, firstly, the antenna set is composed of a specified antenna At (hereinafter referred to as antenna A1) arranged at an intersection of a column A and a row 1 on the back side of the gaming table 10 and an adjacent antenna At (hereinafter referred to as antenna B1) arranged at an intersection of a column B and the row 1 on the back side of the gaming table 10. In this condition, the control unit 14 turns on the antennas A1 and B1 and turns off antennas At other than the antennas A1 and B1 to generate and register row data of the antenna A1. Next, the antenna set is composed of the specified antenna At arranged at the intersection of the column A and the row 1 on the back side of the gaming table 10 and an adjacent antenna At (hereinafter referred to as antenna A2) arranged at an intersection of the column A and a row 2 on the back side of the gaming table 10. In this condition, the control unit 14 turns on the antennas A1 and A2 and turns off antennas At other than the antennas A1 and A2 to generate and register column data of the antenna A1. Finally, the control unit 14 carries out the logical AND operation with respect to the row and column data of the antenna A1 to determine whether or not one or more gaming chips 12 are placed on a betting area 20 located to the intersection of the column A and the row 1, and registers the determination and identification result of the betting area 20 corresponding to the antenna A1.

In the second step, firstly, the antenna set is composed of a specified antenna At (hereinafter referred to as antenna B1) arranged at an intersection of the column B and the row 1 on the back side of the gaming table 10 and adjacent antennas At (hereinafter referred to as antennas A1 and C1) arranged at intersections of the column A and the row 1 and of a column C and the row 1 on the back side of the gaming table 10. In this condition, the control unit 14 turns on the antennas A1, B1 and C1 and turns off antennas At other than the antennas A1, B1 and C1 to generate and register row data of the antenna B1. Next, the antenna set is composed of the specified antenna At arranged at the intersection of the column B and the row 1 on the back side of the gaming table 10 and an adjacent antenna At (hereinafter referred to as antenna B2) arranged at an intersection of the column B and the row 2 on the back side of the gaming table 10. In this condition, the control unit 14 turns on the antennas B1 and B2 and turns off antennas At other than the antennas B1 and B2 to generate and register column data of the antenna B1. Finally, the control unit 14 carries out the logical AND operation with respect to the row and column data of the antenna B1 to determine whether or not one or more gaming chips 12 are placed on a betting area 20 located to the intersection of the column B and the row 1, and registers the determination and identification result of the betting area 20 corresponding to the antenna B1.

Figure 1C:
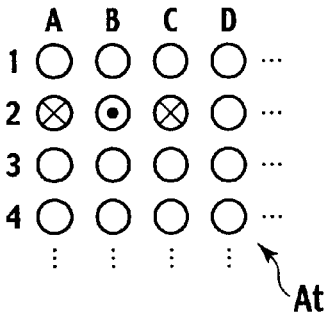
FIG. 1C is an explanatory diagram of a lateral antenna set and each direction of magnetic field in the lateral antenna set in the gaming machine according to the exemplary embodiment of the present invention.
Figure 1D:
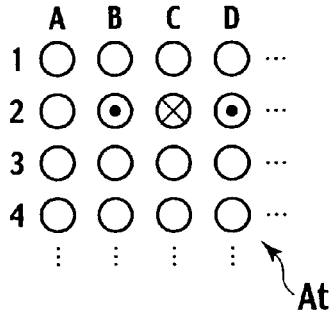
FIG. 1D is an explanatory diagram of a lateral antenna set next to the lateral antenna set shown in FIG. 1C and each direction of magnetic field in the lateral antenna set.

Thus, the control unit 14 sets a specified antenna At in the antenna set along a line of row concerned in series, and generates and registers the determination and identification result of the betting area 20 corresponding to the specified antenna At (see FIGS. 1C and 1D). If all antennas At on the line of row concerned have been set to a specified antenna At in series, the control unit 14 sets a specified antenna At in the antenna set along a next line of row, and generates and registers the determination and identification result of the betting area 20 corresponding to the specified antenna At. It is noted that, if a specified antenna At is located on a line of end column, the antenna set in a line of row is composed of two antennas. It is further noted that, if a specified antenna At is located on a line of end row, the antenna set in a line of column is composed of two antennas. It is furthermore noted that, if a specified antenna At is located on lines of end row and end column, each of the antenna sets in lines of column and row is composed of two antennas.

Figure 1E:
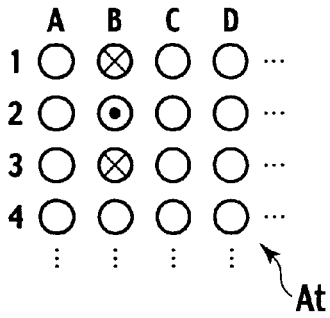
FIG. 1E is an explanatory diagram of a vertical antenna set and each direction of magnetic field in the vertical antenna set in the gaming machine according to the exemplary embodiment of the present invention.
Figure 1F:
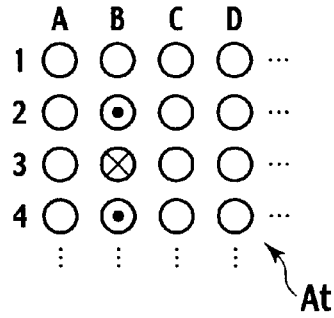
FIG. 1F is an explanatory diagram of a vertical antenna set next to the vertical antenna set shown in FIG. 1E and each direction of magnetic field in the vertical antenna set.
Figure 1G:
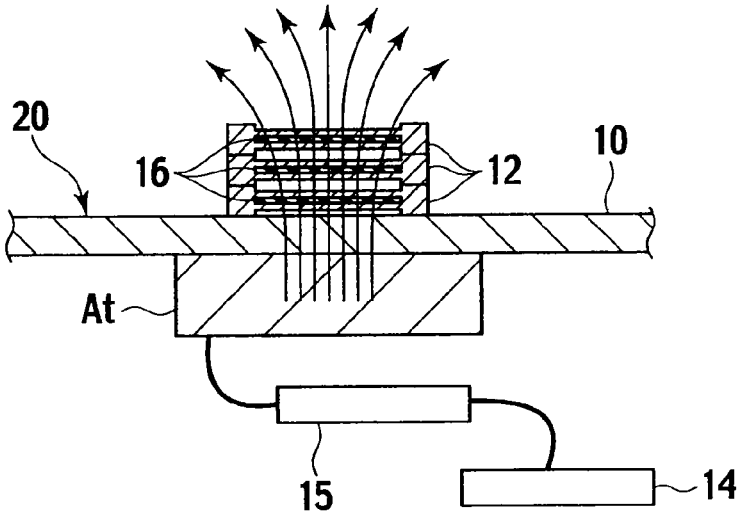
FIG. 1G is a cross-sectional view of a betting area in a state where magnetic filed lines in a magnetic field generated in an antenna passes through gaming media accumulated on the betting area according to the exemplary embodiment of the present invention.
Figure 1H:
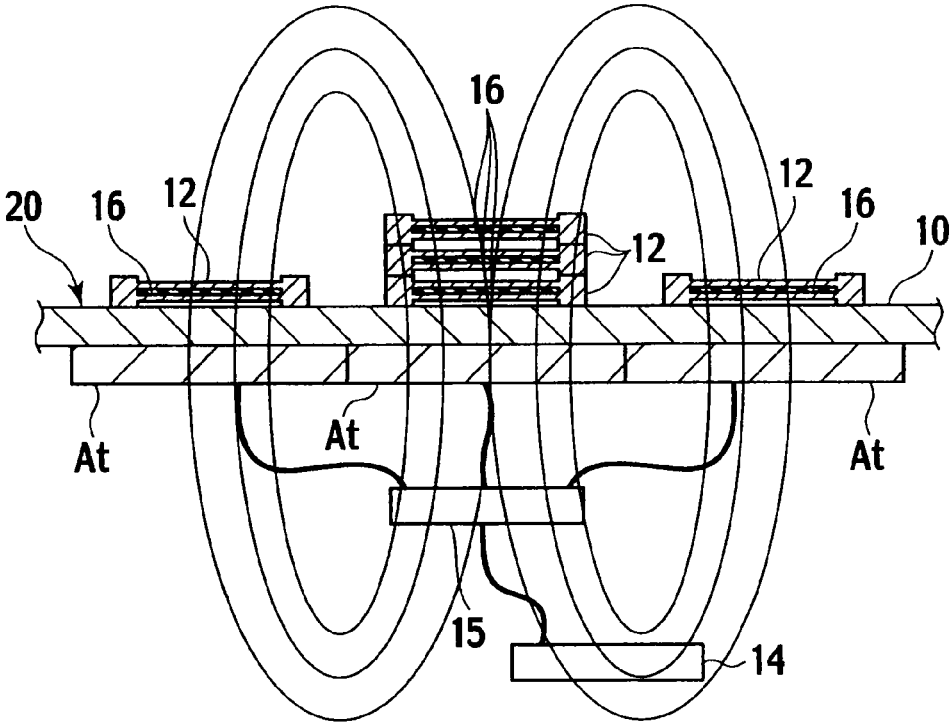
FIG. 1H is a cross-sectional view of a betting area in a state where magnetic filed lines in a magnetic field generated in an antenna and passing through gaming media placed on the betting area are formed in loop shapes according to the exemplary embodiment of the present invention.

Alternatively, the control unit 14 may set a specified antenna At in the antenna set along a line of column concerned in series, and generates and registers the determination and identification result of the betting area 20 corresponding to the specified antenna At (see FIGS. 1E and 1F). If all antennas At on the line of column concerned have been set to a specified antenna At in series, the control unit 14 sets a specified antenna At in the antenna set along a next line of column, and generates and registers the determination and identification result of the betting area 20 corresponding to the specified antenna At.

Also, the control unit 14 may carry out the following alternative processing. Firstly, the control unit 14 sets a specified antenna At in the antenna set along a line of row concerned in series, and generates and registers the row data of the specified antenna At. If all antennas At on the line of row concerned have been set to a specified antenna At in series, the control unit 14 sets a specified antenna At in the antenna set along a next line of row, and generates and registers the row data of the specified antenna At. Next, the control unit 14 sets a specified antenna At in the antenna set along a line of column concerned in series, and generates and registers the column data of the specified antenna At. If all antennas At on the line of column concerned have been set to a specified antenna At in series, the control unit 14 sets a specified antenna At in the antenna set along a next line of column, and generates and register the column data of the specified antenna At. Finally, the control unit 14 sequentially carries out the logical AND operation with respect to the row and column data of the specified antenna At to determine whether or not one or more gaming chips 12 are placed on a betting area 20 located to the intersection of the column and the row concerned, and generates and registers the determination and identification result of the betting area corresponding to the specified antenna At.

When the control unit 14 carries out the logical AND operation with respect to row and column data of a specified antenna At to determine whether or not one or more gaming chips 12 are placed on a betting area located to the intersection of the column and the row concerned, the control unit 14 reads out the row and column data on a RAM thereof from a memory portion thereof and carries out the logical AND operation on the RAM which functions as working area according to a certain program (e.g., determining program) using a CPU thereof.

Further, the control unit 14 may simultaneously turn on two or more antenna sets located at different regions each other on the back side of the gaming table 10. This reduces the time required to detect one or more gaming chips 12 placed on one or more betting areas 20.

Although the above-described antenna set is composed of a specified antenna At and two adjacent antennas At, the antenna set may be composed of a specified antenna At and one adjacent antenna At.

Figure 2A:
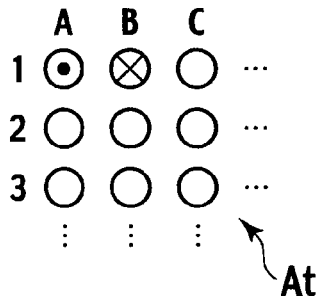
FIG. 2A is an explanatory diagram of a lateral antenna set and each direction of magnetic field in the lateral antenna set according to the exemplary embodiment of the present invention.

For example, in the state of FIG. 2A, the antenna set is composed of a specified antenna (hereinafter referred to as antenna B1) arranged at an intersection of a column B and a row 1 on the back side of the gaming table 10 and an adjacent antenna At (hereinafter referred to as antenna A1) arranged at an intersection a column A and the row 1 on the back side of the gaming table 10. In this condition, the control unit 14 turns on the antennas A1 and B1 and turns off antennas At other than the antennas A1 and B1. Then, the control unit 14 reads pieces of identification information of gaming chips 12 placed on betting areas 20 corresponding to the antennas A1 and B1. The read identification information is registered as row data of the antenna B1. The row data of the antenna B1 includes the pieces of identification information corresponding to the antennas A1 and B1.

Figure 2B:
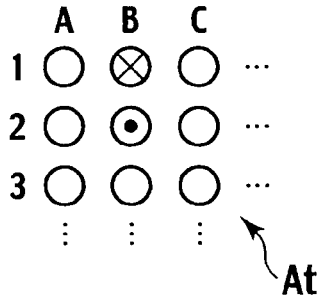
FIG. 2B is an explanatory diagram of a vertical antenna set and each direction of magnetic field in the vertical antenna set according to the exemplary embodiment of the present invention.

For another example, in the state of FIG. 2B, the antenna set is composed of a specified antenna At (hereinafter referred to as antenna B1) arranged at an intersection of a column B and a row 1 on the back side of the gaming table 10 and an adjacent antennas At (hereinafter referred to as antennas B2) arranged at intersections of the column B and a row 2 on the back side of the gaming table 10. In this condition, the control unit 14 turns on the antennas B1 and B2 and turns off antennas At other than the antennas B1 and B2. Then, the control unit 14 reads pieces of identification information of gaming chips 12 placed on betting areas 20 corresponding to the antennas B1 and B2. The read identification information is registered as column data of the antenna B1. The column data of the antenna B1 includes the pieces of identification information corresponding to the antennas B1 and B2.

Then, the control unit 14 compares the row and column data of the antenna B1, and carries out a logical AND operation with respect to the row and column data of the antenna B1. This allows the control unit 14 to recognize only identification information of a gaming chip 12 placed on a specified betting area located to the intersection of the column B and the row 1.

Figure 3:
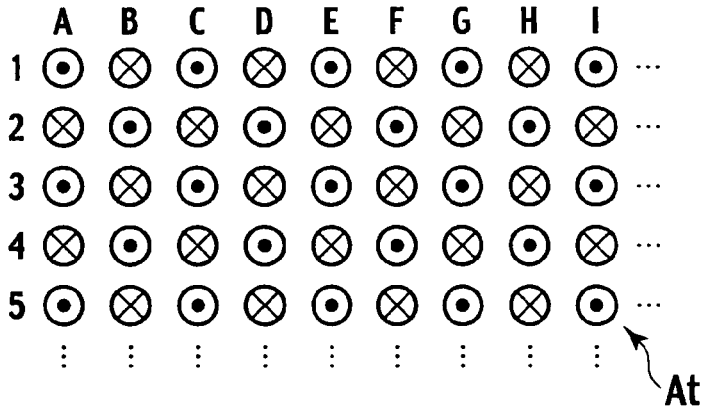
FIG. 3 is an explanatory diagram of each direction of magnetic field in a state where all antennas are driven simultaneously according to the exemplary embodiment of the present invention.

FIG. 3 illustrates each direction of magnetic field in a state where all antennas are driven simultaneously.

Although the control unit 14 sequentially generates and registers row and column data of a specified antenna At, and then carries out the logical AND operation with respect to the row and column data of the specified antenna At to determine whether or not one or more chips 12 are placed on a specified betting area 20 corresponding to the specified antenna At and registers the determination and identification result of the specified batting area 20, these processes may be carried out by a management server (not shown).

When the management server is employed in the roulette gaming machine, the management server is connected to the control unit 14 through suitable interfaces of them (not shown). Under the configuration, these processes are surely carried out in a short time because loads of these processes are distributed to the control unit 14 and the management server (e.g., the control unit 14 generates row and column data of a specified antenna and the management server carries out the logical AND operation with respect to the row and column data of the specified antenna). This allows a game to smoothly proceed.

Further, the management server may be placed in a game hall where various types of gaming machines are placed. In this case, the management server centrally controls the various types of gaming machines. In order to distribute loads of the management server, it is preferable to provide a dedicated server to each gaming machine. For example, there are provided a betting process server for generating row and column data of a specified antenna and carrying out the logical AND operation with respect to the row and column data of the specified antenna, a PTS (Player Tracking System) server for carrying out a game history process, a dividend calculation server for calculating a dividend, and the like.

With reference to FIG. 4, operation of a gaming system using a dedicated server will be described in detail. A roulette system is cited as the gaming system.

Firstly, each player places one or more own gaming chips 12 on one or more desired betting areas 20 to bet the one or more gaming chips 12. At this time, the control unit 14 allows each antenna set to emit a magnetic field toward betting areas 20 corresponding the antenna set concerned, receives an identification signal from a wireless IC chip (IC tag) 16 embedded in each gaming chip 12 placed on the betting areas 20 concerned, and transmits the identification signal to the betting process server.

The betting process server generates and registers row data or column data of a specified antenna At in the antenna set concerned, based on the received identification signal. When the betting process server generates and registers the row and column data of the specified antenna At, it carries out the logical AND operation with respect to the row and column data of the specified antenna At to determine whether or not one or more gaming chips 12 are placed on a batting area 20 corresponding to the specified antenna At, and generates as betting data a determination and identification result (e.g., identification information assigned to one or more gaming chips 12 placed on the betting area 20 and positional information of the betting area 20) of the betting area 20. Then, the betting process server transmits the betting data to the PTS server.

The PTS server calculates a betting value (e.g., one dollar, five dollars or ten dollars) of the one or more gaming chips 12 placed on the betting area 20 concerned, based on the received betting data. Then, the PTS server carries out a history process based on a calculation result. Thereby, a history of roulette is centrally managed in the PTS server. The PTS server transmits to the dividend calculation server data regarding the calculated betting value of the one or more gaming chips 12 and the positional information of the betting area 20 where the one or more gaming chips 12 are placed.

After each player has bet one or more gaming chips 12, a croupier rotates a roulette board (not shown) and throws in a roulette ball (not shown) in the roulette board. The roulette board is provided with a detecting unit for detecting a winning position and a winning type of pocket where the roulette ball is received. Data regarding a detection result of the detecting unit is transmitted to the dividend calculation server in real time. When the dividend calculation server receives the data from the PTS server and the data from the detecting unit, it calculates a dividend of this roulette, based on the winning position and the winning type of pocket where the roulette ball is received and the betting value of the one or more gaming chips 12 and the positional information of the betting area 20 where the one or more gaming chips are placed. It is noted that a wireless IC chip (IC tag) may be embedded in the roulette ball and the detecting unit may communicate with the IC tag to obtain the detection result from the IC tag.

According to the gaming system with the dedicated server, the gaming system can surely identify a betting position, the number and a type of one or more gaming chips 12 placed on a betting area 20 concerned in a short time, and calculate a dividend while centrally managing a history of roulette. This allows a roulette to smoothly and rightly proceed.

What is claimed is:

1. A gaming machine comprising:

a gaming table on which placement areas are formed, wherein at least one gaming medium to which identification information is assigned is placed on any of the placement areas;

detecting units that are arranged to the placement areas and employed to determine whether or not the at least one gaming medium is placed on any of the placement areas;

and a control unit that drives each of the detecting units to generate a radio wave from a detecting unit, which is one of the detecting units, in a direction for passing through a placement area to which the detecting unit is arranged, so as to read identification information assigned to at least one gaming medium placed on the placement area and carry out the determination, wherein the detecting units are arranged in a matrix state with columns and rows, the control unit simultaneously drives at least two detecting units, which are part of the detecting units, positioned on a line of column, so that a polar character of radio wave generated by one detecting unit, which is part of the at least two detecting units, is opposed to one generated by at least one other detecting unit, which is part of the at least two detecting units, adjacent to the one detecting unit, and the control unit reads identification information assigned to one or more gaming media which are part of the at least one gaming medium, and generates column data including the identification information, the control unit simultaneously drives at least two detecting units, which are part of the detecting units, positioned on a row crossing the line of column, so that a polar character of radio wave generated by one detecting unit, which is part of the at least two detecting units, is opposed to one generated by at least one other detecting unit, which is part of the at least two detecting units, adjacent to the one detecting unit, and the control unit reads identification information assigned to one or more gaming media which are part of the at least one gaming medium, and generates row data including the identification information, and the control unit carries out a logical AND operation with respect to the column and row data to determine whether or not one or more gaming media which are part of the at least one gaming medium, are placed on a placement area corresponding to an intersection of the lines of column and row.

2. The gaming machine according to claim 1, wherein the polar character of radio wave is a direction of magnetic field.

3. The gaming machine according to claim 1, wherein the control unit simultaneously drives at least two sets of at least two detecting units which are part of the detecting units, so that a polar character of radio wave generated by one detecting unit, which is part of the at least two detecting units, is opposed to one generated by at least one other detecting unit, which is part of the at least two detecting units, adjacent to the one detecting unit in each set.

* * * * *